US007140330B2

(12) United States Patent
Rogers et al.

(10) Patent No.: US 7,140,330 B2
(45) Date of Patent: Nov. 28, 2006

(54) COOLANT SYSTEM WITH THERMAL ENERGY STORAGE AND METHOD OF OPERATING SAME

(75) Inventors: C. James Rogers, Racine, WI (US); Werner Zobel, Böeblingen (DE); Mark G. Voss, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/889,707

(22) Filed: Jul. 13, 2004

(65) Prior Publication Data

US 2006/0011150 A1 Jan. 19, 2006

(51) Int. Cl.
*F03P 3/20* (2006.01)

(52) U.S. Cl. ..... 123/41.14; 123/41.01

(58) Field of Classification Search ..... 123/41.14
See application file for complete search history.

(56) References Cited

U.S. PATENT DOCUMENTS 1,233,100 A 7/1917 Modine
1,632,596 A * 6/1927 Grantier ..... 123/41.14
5,211,334 A 5/1993 Schatz
5,279,355 A 1/1994 Schatz
5,299,630 A 4/1994 Schatz
5,425,333 A * 6/1995 Baylor et al. ..... 123/41.14
5,435,277 A * 7/1995 Takahashi ..... 123/142.5 E
5,558,055 A 9/1996 Schatz
5,662,072 A * 9/1997 Suzuki et al. ..... 123/41.14
5,749,329 A * 5/1998 Thurfjell ..... 123/41.14
5,749,330 A * 5/1998 Inque et al. ..... 123/41.1
5,765,511 A 6/1998 Schatz
5,884,588 A * 3/1999 Ap et al. ..... 123/41.14
6,464,027 B1 * 10/2002 Dage et al. ..... 180/65.2
6,571,752 B1 * 6/2003 Suzuki ..... 123/41.14
6,769,623 B1 * 8/2004 Ban et al. ..... 237/12.3 B
6,895,904 B1 * 5/2005 Kobayashi et al. ..... 123/41.14
6,915,763 B1 * 7/2005 Arisawa et al. ..... 123/41.14

OTHER PUBLICATIONS

Advertising material entitled "How the Heat Storage System recycles waste heat into usable heat".

Advertising material entitled "Turn on Instant Heat! The Schatz Heat Storage Battery" (Centaur Thermal Systems Inc.).

(Continued)

*Primary Examiner*—Henry C. Yuen
*Assistant Examiner*—Jason Benton
(74) *Attorney, Agent, or Firm*—Wood, Phillips, Katz, Clark & Mortimer

(57) ABSTRACT

A coolant system includes a heat exchange circuit capable of being in a heat exchange relationship with a heat generating component, such as an engine, to remove thermal energy from the engine and transfer the thermal energy to a coolant, and an insulated tank in fluid communication with the heat exchange circuit. The system also includes a control and associated conduits and valves for passing coolant through the heat exchange circuit and the insulated tank so as to fill the tank with a first volume of coolant in a first operational state, for passing an additional amount of coolant from the heat exchange circuit into the insulated tank so as to fill the insulated tank with a second volume of coolant which is greater than the first volume of coolant in a second operational state, and for passing the additional amount of coolant from the insulated tank to the heat exchange circuit in a third operational state. A method of operating the coolant system to store thermal energy is also provided.

36 Claims, 7 Drawing Sheets

OTHER PUBLICATIONS

Advertising material entitled "The Schatz Type "B" Heat Storage Battery " (Centaur Thermal Systems Inc.).
Press Release entitled "Centaur Thermal Settings", *The Dallas Morning News* (Jan. 26, 1998).
Press Release entitled "Instant Heat From Centaur" (Jan. 30, 1998).
Print on Calstart Web Page (Jan. 30, 1998).
"Heat Battery Downsized, Improved", *Ward's Engine and Vehicle Technology Update* (Dec. 1, 1995).

* cited by examiner

COOLANT SYSTEM WITH THERMAL ENERGY STORAGE AND METHOD OF OPERATING SAME

FIELD OF THE INVENTION

The present invention relates to a coolant system with thermal energy storage and a method of operating the system to store thermal energy, and in particular to a coolant system equipped with a sensible heat battery and a method of operating the coolant system to store thermal energy in the sensible heat battery.

BACKGROUND OF THE INVENTION

Thermal energy storage devices can find use in many applications. For example, they can be used to preheat fuel cell coolant to heat a fuel cell stack, particularly on vehicles such as hybrid vehicles that include a fuel cell, to preheat the engine of a vehicle for rapid engine warm-up, to preheat a transmission for rapid transmission warm-up, and/or to heat a passenger compartment of a vehicle under conditions where the heat from the vehicle engine is not sufficient.

One way to heat the passenger compartment of a vehicle equipped with an internal combustion engine is to redirect some of the thermal energy carried away from the engine by the coolant system. Normally, coolant circulates between the engine and a radiator, absorbing thermal energy from the engine and rejecting the thermal energy to the environment via the radiator. To heat the passenger compartment, a portion of coolant from the engine is diverted to a secondary heat exchanger, where the coolant rejects its thermal energy to a stream of air, which is subsequently directed into the passenger compartment.

However, the supply of thermal energy in the coolant system often lags behind the demand for warmer cabin temperatures. In particular, if the engine is turned off in the cold weather, the thermal energy carried by the coolant system will soon dissipate into the environment. If the engine is then restarted and the heater turned on, cold air may actually be exhausted into the passenger compartment because the coolant is not warm enough to sufficiently heat the air stream passing through the secondary heat exchanger. Most people find this to be uncomfortable and undesirable.

To reduce this supply-demand problem, it is known in the art to equip the coolant system with heat batteries. Heat batteries are rechargeable devices which store the thermal energy generated during the operation of the engine for later release. Conventionally, heat batteries are included as an add-on to the standard coolant system, which, as described above, includes the radiator and the secondary heat exchanger as well as a circulation pump, a surge tank, and a series of conduits to connect the radiator, secondary heat exchanger, circulation pump and surge tank.

One commonly-used type of heat battery is a sensible heat battery. A conventional sensible heat battery is constructed by disposing an inner container within an outer container to define a space therebetween, and by filling the space with insulation. During the time the engine is operational, the circulation pump forces coolant through the coolant system and the inner container of the heat battery. When the engine is turned off, the circulation pump is deactivated and the coolant contained in the inner container of the battery is retained therein, the insulation preventing the thermal energy carried by this coolant from being rapidly exhausted to the environment. Upon subsequent start-up, the circulation pump forces the coolant in the battery out of the battery and through the remainder of the coolant system. See U.S. Pat. Nos. 5,558,055 and 5,765,511.

There are drawbacks, however, to adding sensible heat batteries to conventional coolant systems. Because coolant can only carry so much thermal energy in the form of sensible heat, the conventional sensible heat battery is quite large. To accommodate the addition of the heat battery to the coolant system, it may be necessary to remove or repackage other accessories, or enlarge the size of the engine compartment. Furthermore, the weight of the additional coolant needed to fill the heat battery (over that required to fill the coolant system) can degrade such weight-dependent performance characteristics as fuel economy. Moreover, heat batteries can be expensive to install and maintain.

Alternatively, it is known in the art to divert a portion of the coolant from the coolant system to the heat battery only when the engine is turned off. The diverted coolant is retained in the insulated heat battery to limit the loss of thermal energy. Prior to start-up, the coolant is returned to the cooling system. See U.S. Pat. No. 5,299,630.

However, it is believed that problems may arise when the coolant in the heat battery is pumped back into the coolant system. As the coolant displaces the air in the engine jacket, some of the coolant will become entrained in the exiting air stream. This coolant returns to the heat battery via a vent line, and remains there after the pump is deactivated. Consequently, with this heat battery there will always be some coolant which cannot be recovered for use in the coolant system.

SUMMARY OF THE INVENTION

According to an aspect of the present invention, a coolant system includes a heat exchange circuit capable of being in a heat exchange relationship with a heat generating component such as an engine to remove thermal energy from the engine and transfer the thermal energy to a coolant, and an insulated tank in fluid communication with the heat exchange circuit. The system also includes a control and associated conduits and valves for passing coolant through the heat exchange circuit and the insulated tank so as to fill the tank with a first volume of coolant in a first operational state, for passing an additional amount of coolant from the heat exchange circuit into the insulated tank so as to fill the insulated tank with a second volume of coolant which is greater than the first volume of coolant in a second operational state, and for passing the additional amount of coolant from the insulated tank to the heat exchange circuit in a third operational state.

The insulated tank may have first and second ports, and the control may include a first valve in fluid communication with the first port and the heat exchange circuit, and a second valve in fluid communication with the second port and the heat exchange circuit. The first and second valves have a first operational state wherein both valves are open to allow coolant to pass from the heat exchange circuit through the tank and a second operational state wherein the first valve is open and the second valve is closed to allow coolant to enter or exit the tank. A pump is disposed in fluid communication with the heat exchange circuit and the first valve, and has a first operational state wherein the pump passes coolant from the heat exchange circuit into the tank and a second operational state wherein the pump passes coolant from the tank to the heat exchange circuit. The pump may be a reversible, positive displacement pump.

The system may include a conduit in fluid communication with the heat exchange circuit and the first port of the tank to allow coolant to pass between the heat exchange circuit and the tank without passing through the first valve. A third valve may be disposed in fluid communication with the conduit to limit the flow of coolant from the tank to the heat exchange circuit through the conduit. The third valve may be a check valve.

A coolant-to-air heat exchanger may be disposed in fluid communication with the first valve and the pump to receive coolant passing between the tank and the heat exchange circuit.

The heat exchange circuit may include a radiator, an engine jacket in fluid communication with the radiator, and a circulation pump in fluid communication with the radiator and the engine jacket to pass coolant between the radiator and the engine jacket.

The insulated tank may have a first wall, and the control may include a second wall which with the first wall defines a coolant reservoir therebetween in fluid communication with the heat exchange circuit, the second wall being moveable relative to the first wall between first and second positions to vary the volume of the coolant reservoir between the first volume and the second volume. The second wall may be a flexible membrane.

The first wall may enclose a space, and the second wall may be disposed in the space to divide the space to define the coolant reservoir and a control fluid reservoir, the coolant reservoir and the control fluid reservoir being hydraulically isolated from each other. A pump may be disposed in fluid communication with the control fluid reservoir to pass control fluid into the control fluid reservoir in a first operational state to move the second wall in a first direction and to pass fluid out of the control fluid reservoir in a second operation state to move the second wall in a second direction opposite to the first direction. The control may also include a valve in fluid communication with the control fluid reservoir and the pump, the valve having a first operational state wherein the valve is open to allow fluid to pass between the control fluid reservoir and the pump and a second operational state wherein the valve is closed to limit fluid from passing between the control fluid reservoir and the pump.

According to still another aspect of the present invention, a method of operating a coolant system to store thermal energy includes providing a heat generating component such as an engine, a heat exchange circuit in a heat exchange relationship with the engine to remove thermal energy from the engine and transfer the thermal energy to a coolant, and an insulated tank. The coolant passes through the heat exchange circuit and the insulated tank so as to fill the tank with a first volume of coolant in a first operational state. An additional amount of coolant passes from the heat exchange circuit into the insulated tank so as to fill the insulated tank with a second volume of coolant which is greater than the first volume of coolant in a second operational state. The second volume of coolant is retained in the insulated tank in a third operational state. The additional amount of coolant passes from the insulated tank to the heat exchange circuit in a fourth operational state.

The step of passing an additional amount of coolant from the heat exchange circuit to the insulated tank may include the sequential steps of deactivating the engine, waiting a period of time, and passing an additional amount of coolant from the heat exchange circuit into the insulated tank so as to fill the insulated tank with a second volume of coolant which is greater than the first volume of coolant in a second operational state after the period of time has elapsed. The step of passing the additional amount of coolant from the insulated tank to the heat exchange circuit may include the sequential steps of determining whether an engine activation signal is present, and passing the additional amount of coolant from the insulated tank to the heat exchange circuit in a fourth operational state if the engine activation signal is present.

The step of providing an insulated tank may include the step of providing an insulated tank with first and second spaced walls defining a coolant reservoir therebetween in fluid communication with the heat exchange circuit, the second wall being moveable relative to the first wall to vary the volume of the coolant reservoir. The step of passing an additional amount of coolant from the heat exchange circuit into the insulated tank may then include the step of moving the second wall in a first direction to draw coolant from the heat exchange circuit into the coolant reservoir. Further, the step of passing the additional amount of coolant from the insulated tank to the heat exchange circuit may include the step of moving the second wall in a second direction opposite to the first direction to exhaust the coolant from the coolant reservoir into the heat exchange circuit.

The step of moving the second wall in a first direction to draw coolant from the heat exchange circuit into the coolant reservoir may include the sequential steps of deactivating the engine, waiting a period of time, and moving the second wall in a first direction to draw coolant from the heat exchange circuit into the coolant reservoir after the period of time has elapsed. The step of moving the second wall in a second direction opposite to the first direction to exhaust the coolant from the coolant reservoir into the heat exchange circuit may include the sequential steps of determining whether an engine activation signal is present, and moving the second wall in a second direction opposite to the first direction to exhaust the coolant from the coolant reservoir into the heat exchange circuit if the engine activation signal is present.

DETAILED DESCRIPTION OF THE PREFERRED EMBODIMENTS

Figure 3:
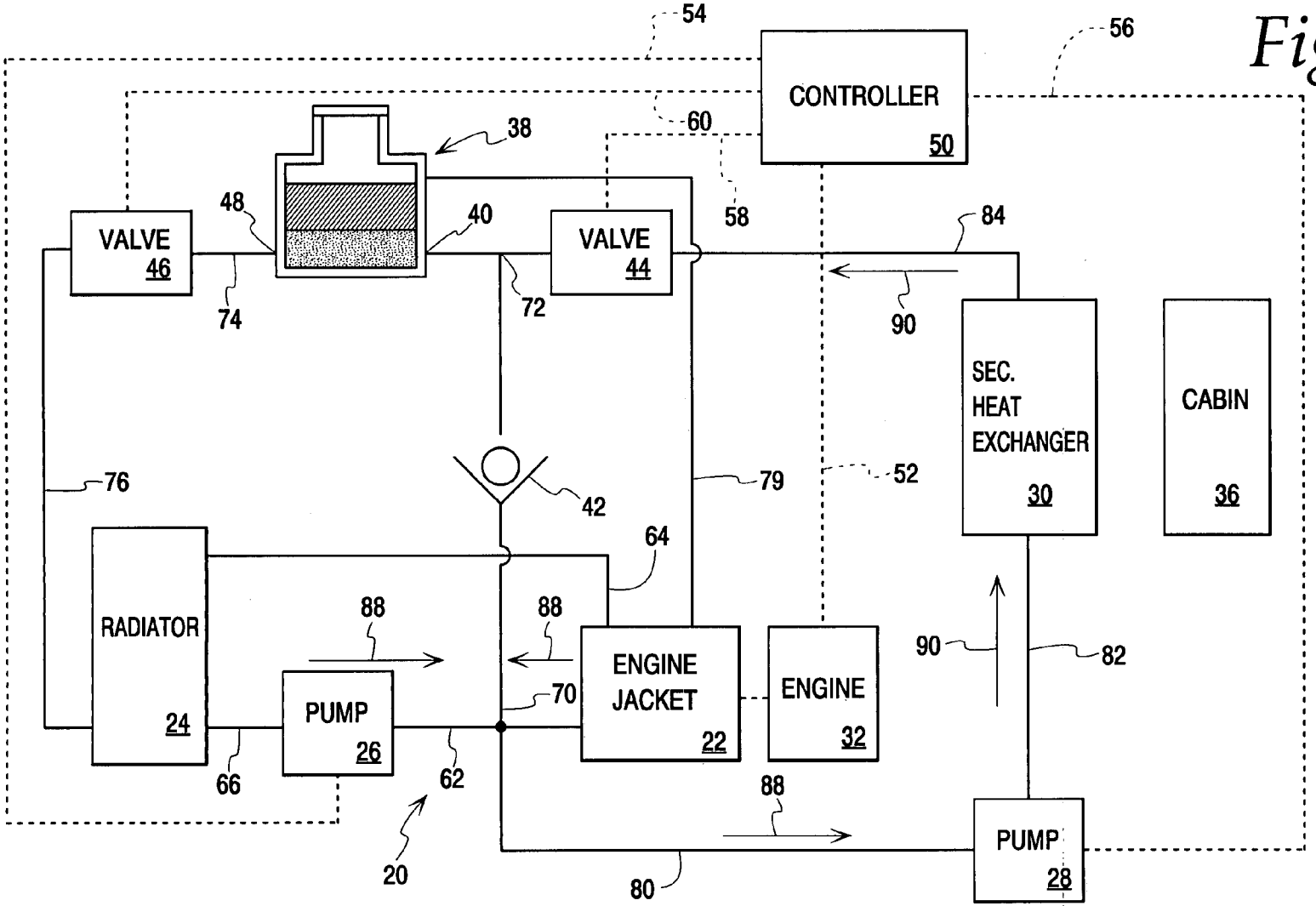
FIG. 3 is a schematic view of the system of FIG. 1 in a storage state.
Figure 4:
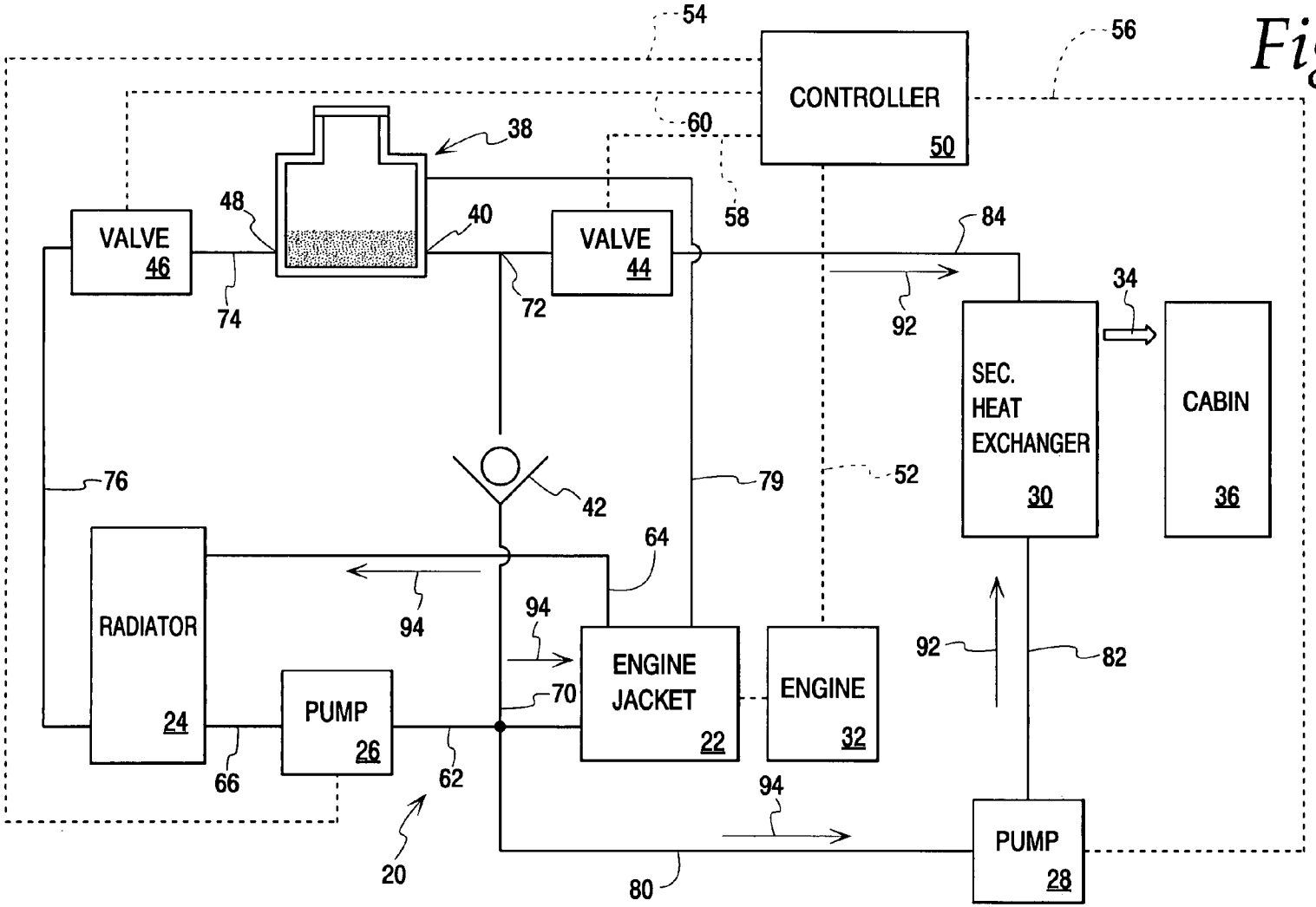
FIG. 4 is a schematic view of the system of FIG. 1 in a start-up state.
Figure 5:
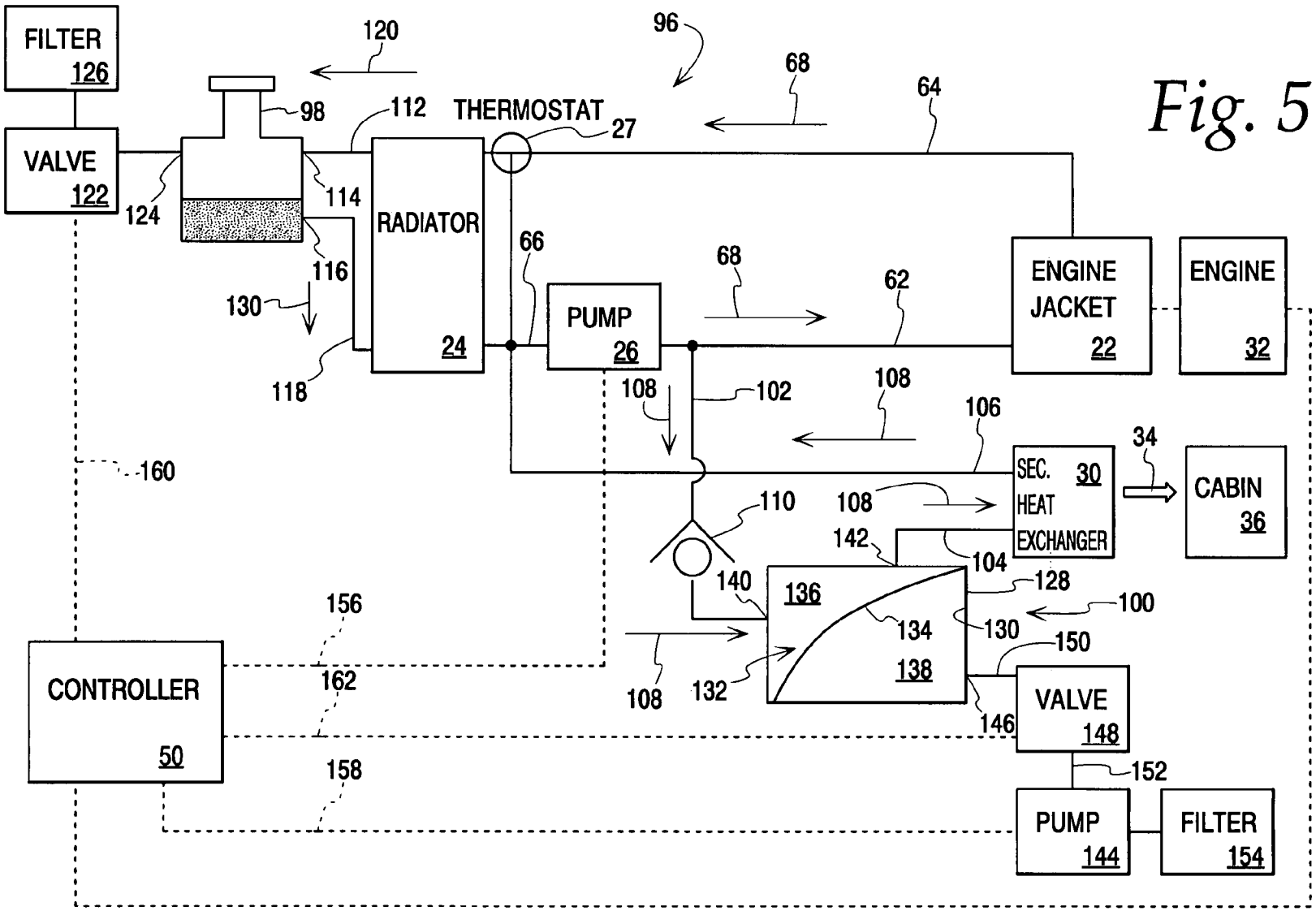
FIG. 5 is a schematic view of a coolant system according to another embodiment of the present invention in a stand-by state.
Figure 6:
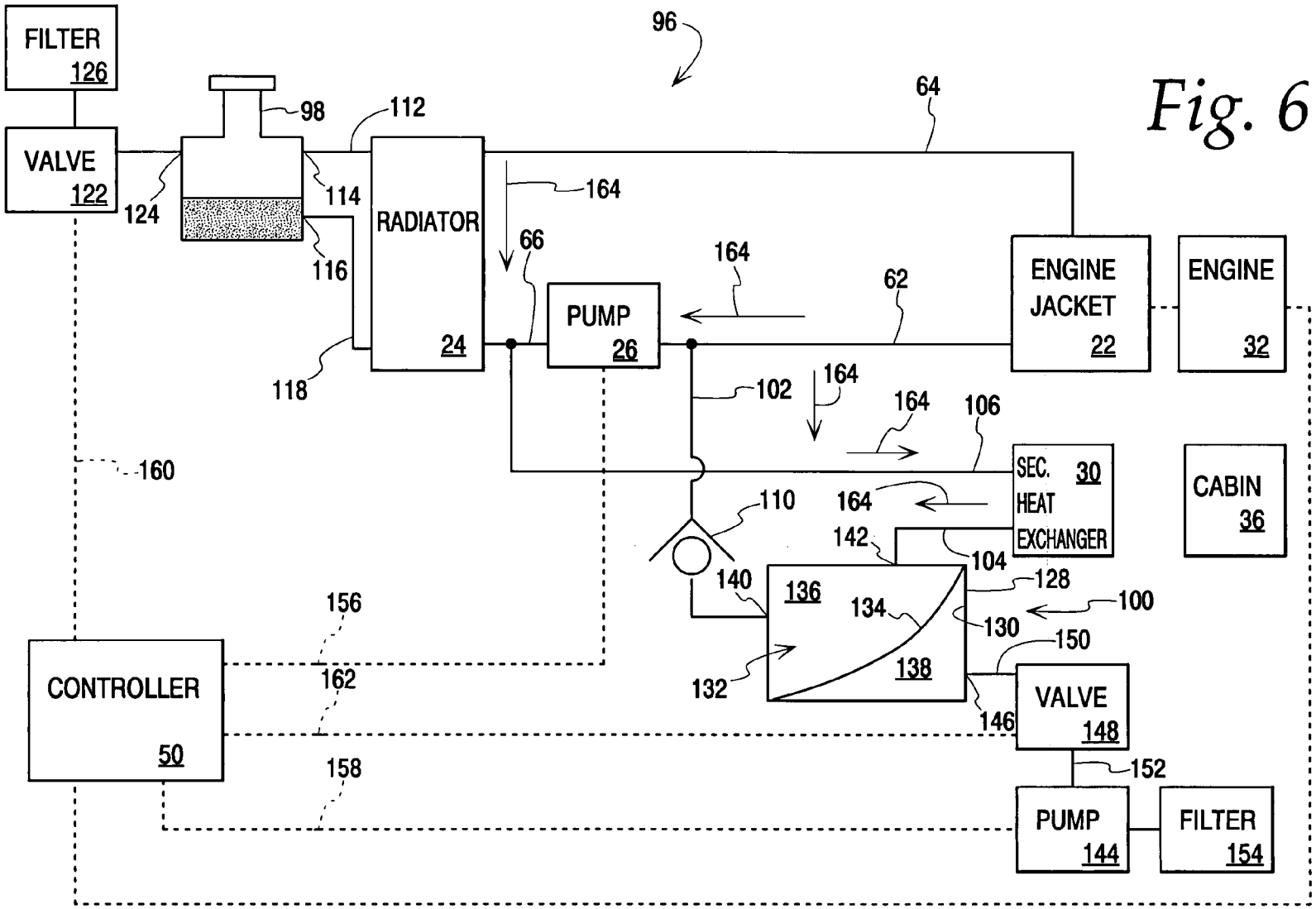
FIG. 6 is a schematic view of the system of FIG. 5 in a storage state.
Figure 7:
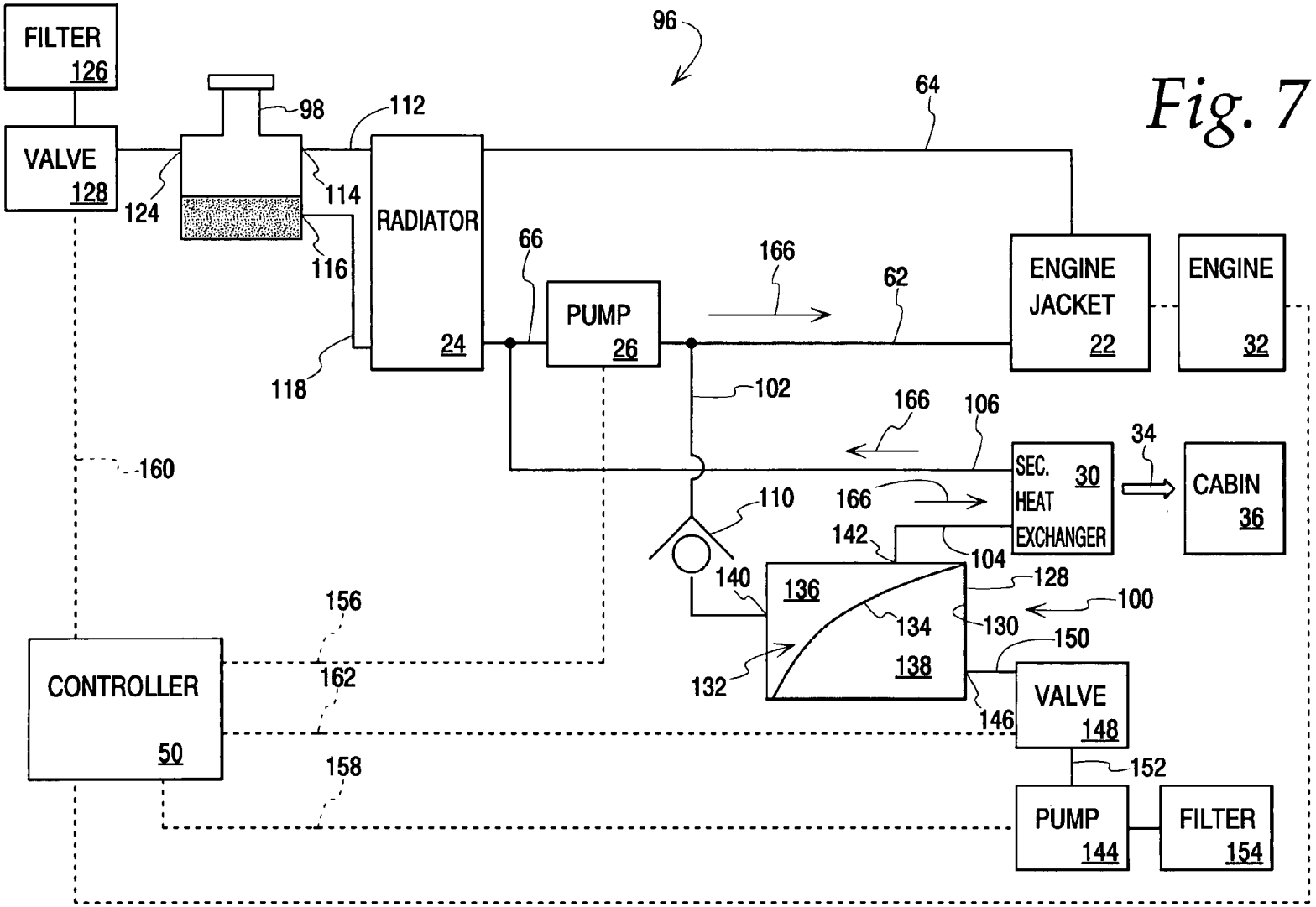
FIG. 7 is a schematic view of the system of FIG. 5 in a start-up state.

FIGS. 1–4 illustrate one embodiment of a coolant system with thermal energy storage according to the present invention, while FIGS. 5–7 illustrate another embodiment of the present invention. In both systems, coolant is removed from the coolant system for storage in an insulated tank during periods of engine inactivity and is returned to the coolant system prior to reactivation of the engine. Additionally, in both systems, a method and mechanism is provided to maximize the return of the stored coolant to the coolant system. Further, in both systems, a mechanism and a method is provided for passing heated coolant through the storage tank during engine operation to continuously warm the coolant in the tank.

Figure 1:
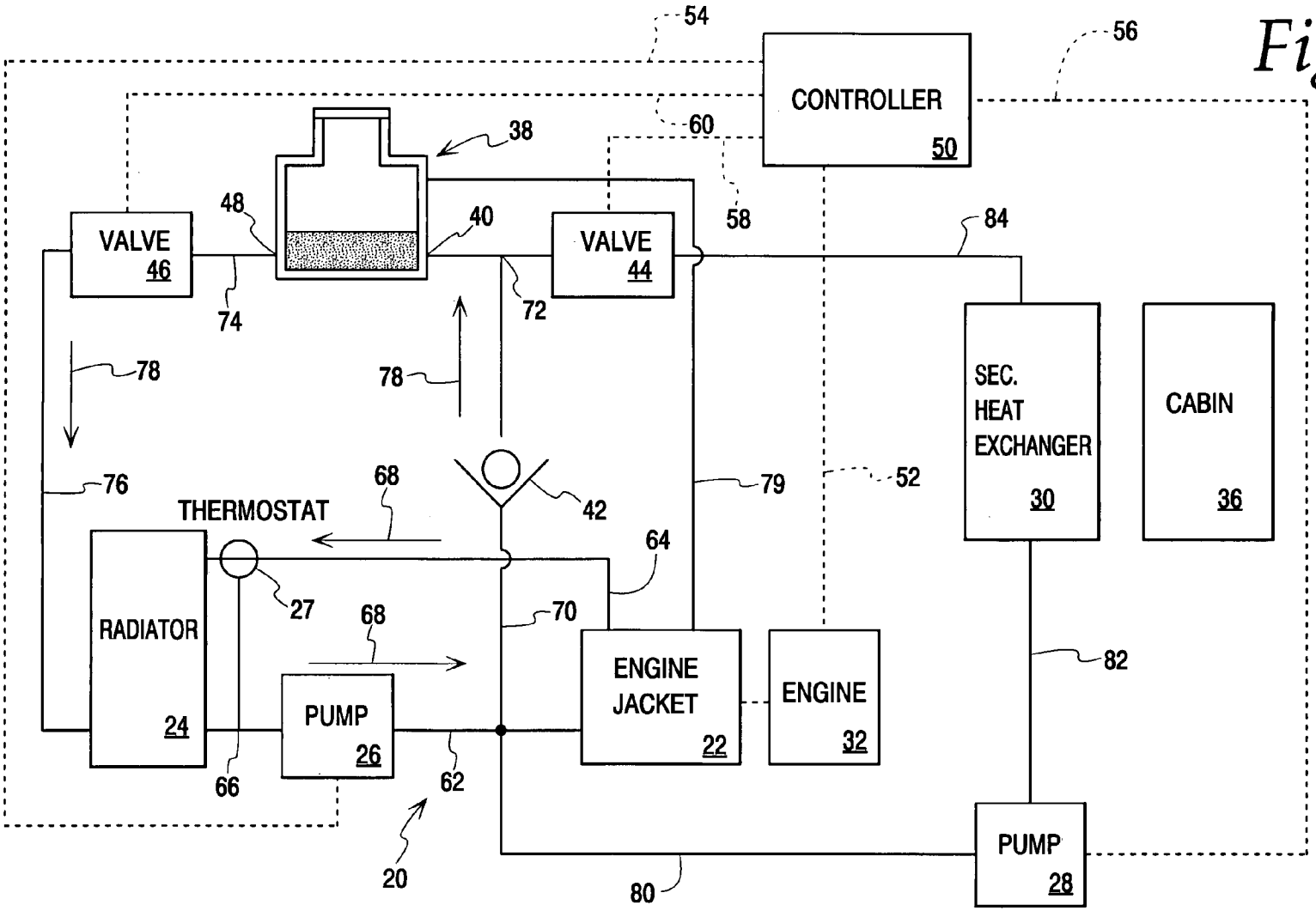
FIG. 1 is a schematic view of a coolant system according to an embodiment of the present invention in a stand-by state.

Specifically, according to the first embodiment of the invention, a coolant system 20 is shown in FIG. 1. The coolant system 20 includes an engine coolant jacket 22, a radiator 24, a circulation pump 26, and a thermostat 27 to control the temperature of the coolant by bypassing coolant around the radiator 24 to the inlet side of the pump 26 in a known fashion. The coolant system 20 also includes an electrically-driven, reversible pump 28 (for example, a gear pump or a vane pump) and a secondary (coolant-to-air) heat exchanger 30.

Under normal operating conditions (FIG. 1), coolant in the jacket 22 absorbs thermal energy from a heat generating component shown in the form of an engine 32 in a heat exchange relationship with the jacket 22. The circulation pump 26 forces the coolant to circulate between the jacket 22 and the radiator 24 (FIG. 1). At the radiator 24, the coolant rejects the thermal energy of the hot coolant to the environment.

Figure 2:
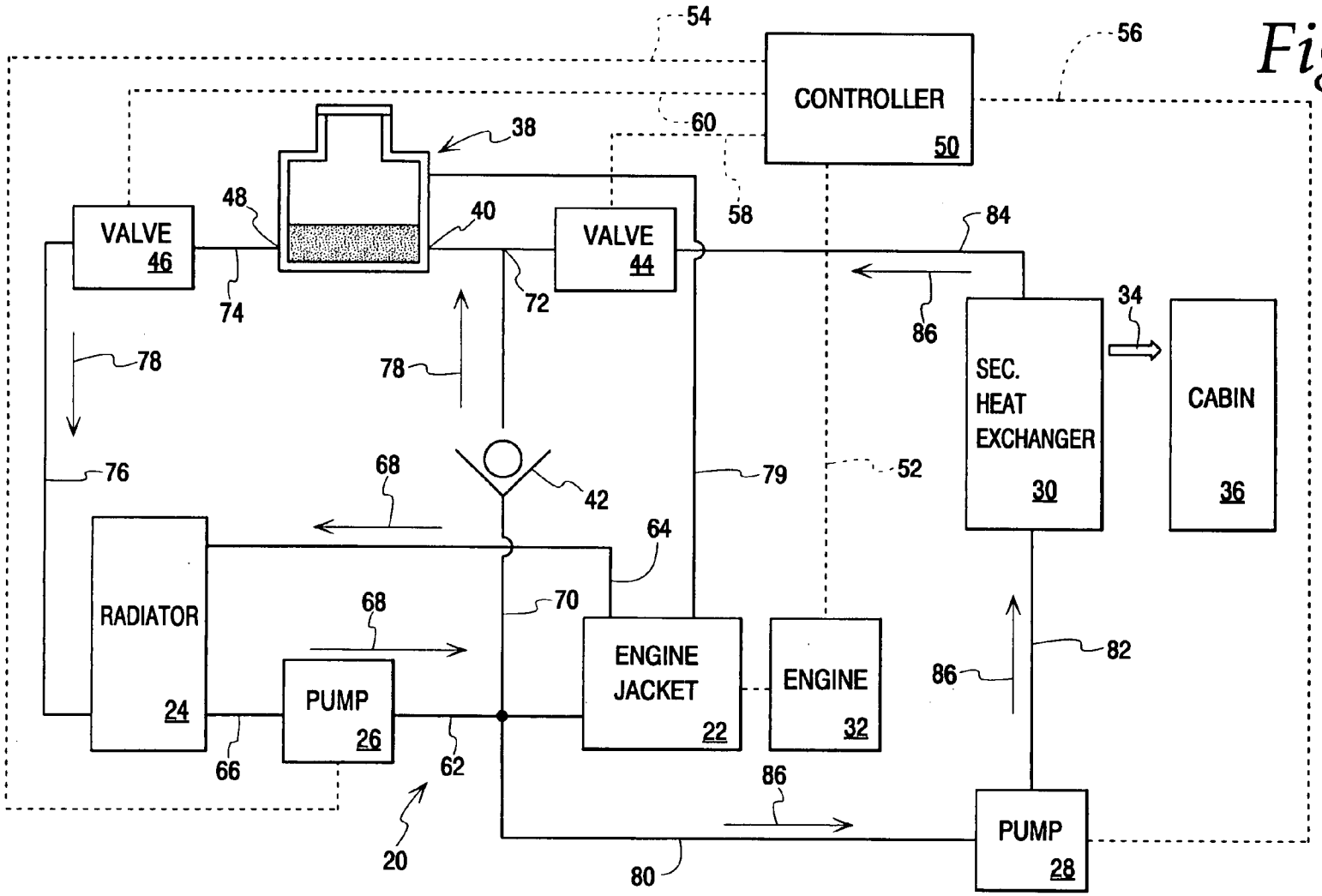
FIG. 2 is a schematic view of the system in FIG. 1 in a heating state.

By activating the reversible pump 28, a portion of the coolant circulating between the jacket 22 and the radiator 24 can be diverted to the secondary heat exchanger 30 (FIG. 2). At the secondary heat exchanger 30, the coolant rejects thermal energy to warm a stream of air 34 (FIG. 2) passing therethrough. The air stream 34 can be directed into a passenger compartment 36 to increase the temperature.

The coolant system 20 also includes a tank 38, which may be insulated by generating a vacuum between inner and outer containers of the tank 38. Under the operational conditions discussed above, coolant enters a first port 40 of the tank 38 either via the reversible pump 28 and secondary heat exchanger 30 or via a spring-loaded check valve 42 connected to the high pressure side of the pump 26 (and by virtue of the lower downstream pressure caused by the isolating effect of the positive displacement pump 28). A first solenoid valve 44 limits the flow of coolant entering the tank 38 via the reversible pump 28 and the secondary heat exchanger 30. Similarly, a second solenoid valve 46 limits the coolant exiting the tank 38 by a second port 48 connected to the radiator 24.

The tank 38 provides two functions for the coolant system 20. First, the tank 38 provides the conventional function of a surge tank, i.e. to serve as a receptacle for make-up coolant and may include a pressure and vacuum relief valve as is also conventional. Second, the tank 38 provides the function of a thermal energy storage device (i.e., heat battery) for the coolant system 20.

Specifically, a controller 50 is provided to operate the system 20 so that the tank 38 can be used as a thermal energy storage device. The controller 50 monitors engine activity via an input 52 and controls operation of the pumps 26, 28 and the solenoid valves 44, 46 via outputs 54, 56, 58, 60. Upon sensing that the engine 32 has been turned off, the controller 50 closes the valve 46, and turns on the pumps 26, 28 to pump a sufficient amount of coolant out of the remainder of the coolant system 20 to substantially fill the tank 38. After the tank 38 has been filled, the controller 50 turns the pumps 26, 28 off and closes the valve 44. With the solenoid valves 44, 46 closed, the coolant is retained in the tank 38. Before or during start-up, the controller 50 opens the valve 44 and activates pumps 26 and 28 to withdraw the coolant previously pumped into the tank 38 and to return it to the coolant system 20 through the valve 44.

Because the tank 38 provides both surge tank and thermal energy storage functions for the coolant system 20, it is unnecessary to provide two containers to perform each of these functions separately. Additionally, the tank 38 achieves the thermal energy storage function by using a volume of coolant withdrawn from the total volume of coolant normally circulating between the jacket 22 and the radiator 24, rather than requiring coolant to be added to the normally circulating volume. Further, because coolant circulates through the surge tank 30 during normal operation of the coolant system 20 (FIGS. 1 and 2), the volume of coolant temporarily contained in the surge tank 38 is kept warm against the possibility of future use. Moreover, all of the coolant retained in the tank 38 during periods of engine inactivity is available for circulation in the coolant system 20 upon subsequent start-up; no coolant is "lost" in the surge tank/heat battery 38, i.e., unavailable for circulation in the coolant system 20.

The structure and operation of the coolant system 20 are now described in greater detail with reference first to FIG. 1. FIG. 1 illustrates a first operational state of the system 20 referred to herein as a stand-by state. In this state, the engine 32 is on, but the controller 50 has closed the valve 44 and turned off the pump 28 to prevent coolant from passing through the secondary heat exchanger 30 because no request has been received to increase the temperature of the compartment 36. The valve 46 is open at this time.

In the stand-by state, most of the coolant exiting the pump 26 passes through a conduit 62 into the jacket 22, wherein the coolant absorbs thermal energy from the engine 32. The coolant then passes through a conduit 64, which connects the jacket 22 to the radiator 24. As the coolant passes through the radiator 24, the coolant exhausts the thermal energy absorbed from the engine 32 to a stream of air (not shown) passing through the radiator 24. The coolant subsequently returns through a conduit 66 to the pump 26. The path of the coolant through the jacket 22, radiator 24, pump 26 and conduits 62, 64, 66 is shown by arrows 68.

However, not all of the coolant follows the path between the jacket 22, radiator 24 and pump 26. Some of the coolant passes from the conduit 62 into the tank 38 via a conduit 70, the valve 42, and a T-connection 72 interconnecting the valve 42, the valve 44 and the tank 38. The coolant returns to the radiator 24 via the valve 46 and conduits 74, 76. This alternate path for the coolant is shown by arrows 78.

Additionally, a vent line 79 is provided connecting the jacket 22 to the tank 38, through which air may vent from the jacket 22 to the tank 38, and from the tank 38 to the jacket 22. The vent line 79 allows air to pass into the tank 38 from the jacket 22 as coolant is pumped out into the remainder of the system 20, and to pass into the jacket 22 as coolant is pumped into the tank 38 from the remainder of the system 20.

FIG. 2 shows a second operational state of the coolant system 20 referred to herein as a heating state. The operation of the system 20 in the heating state is substantially similar to that shown in FIG. 1 in that the engine 32 is turned on and most of the coolant circulates through the jacket 22, radiator 24, pump 26 and tank 38 as shown by arrows 68, 78. However, in response to a request to heat the compartment 36, the controller 50 opens the valve 44 and activates the pump 28 so that some of the coolant is diverted to the secondary heat exchanger 30.

In particular, the pump 28 draws coolant through a conduit 80 from the conduit 62. The diverted coolant is discharged into a conduit 82, which is connected to the secondary heat exchanger 30. The coolant passes through the heat exchanger 30, and exhausts its thermal energy into the air stream 34 passing through the heat exchanger 30. The coolant then passes through a conduit 84 from the secondary heat exchanger 30 to the valve 44. The diverted coolant stream is combined with the coolant stream passing through the valve 42, and the resultant stream enters the tank 38, returning to the radiator via the conduits 74, 76. The path of the coolant through the secondary heat exchanger 30 is shown by arrows 86.

By using the positive displacement pump 28, an ancillary advantage is obtained. Specifically, by controlling the coolant flow delivered by the pump 28, the quantity of thermal energy transferred via the air stream 34 to the passenger compartment 36 may be modulated without the use of conventional mixing doors. On the other hand, the use of the pump 28 does not prevent the system 20 from being used with a ventilation system for guiding the air stream 34 which incorporates mixing doors as well.

FIG. 3 shows a third operational state of the coolant system 20 referred to herein as a storage state. The storage state comes into being shortly after the engine 32 has been turned off. The controller 50 executes a time delay before entering the storage state from either of the previous two states to prevent removal of the coolant from the coolant system 20 until the temperature of the engine 32 has been lowered to a level to prevent damage to the engine and its components and to maximize the temperature level of the coolant.

In the storage state, the controller 50 first closes the valve 46. The controller then activates pump 28 if not already activated and places the pump 28 in the proper operational state to draw coolant through the conduit 80 from the jacket 22 and the radiator 24 as shown by the arrows 88. If the system 20 has recently been in the heating state, then it is not necessary to reverse the operation of the pump 28. If the system 20 enters the storage state from the stand-by state, then the pump 28 will need to be reversed as the pump 28 was deactivated in the start-up state after pumping coolant from the tank 38. The withdrawn coolant passes through the heat exchanger 30 and conduits 80, 82, 84, into the tank 38 as shown by the arrows 90. At the same time, air is exhausted from the tank 38 via the vent line 79 back to the engine jacket 22.

The controller 50 continues to operate the pumps 26, 28 until a sufficient amount of coolant is withdrawn from the jacket 22 and radiator 24 to substantially fill the tank 38. The controller 50 may make the determination that the sufficient amount of coolant has been withdrawn from the remainder of the system 20, for example, by inspecting the output of a sensor placed within the tank 38, by timing the period of operation of pump 28, or, if the pump 28 is electrically commutated, by counting the number of pump revolutions. In short, the controller 50 may perform any of a number of different methods for determining the amount of coolant pumped into the tank 38.

Upon determining that the sufficient amount of coolant has been pumped into the tank 38, the controller 50 turns off the pumps 26, 28 and closes the valve 44. By closing the valve 44 and because the valve 46 is already closed, the coolant is trapped in the tank 38. The coolant contained within the surge tank 38 may be maintained therein at its temperature for several hours to several days, depending on the insulation surrounding the tank 38.

FIG. 4 illustrates a fourth state of the coolant system 20 referred to herein as a start-up state. While in some systems it may be desirable for the coolant to be drawn into the engine after the engine has started, it is preferred that the start-up state occurs shortly after the user indicates his or her desire to turn on the engine 32, but before the engine 32 is actually activated. A time delay is preferred to ensure that the coolant removed in the storage state is returned to the jacket 22 and the radiator 24 to prevent damage to either of these elements or the engine 32. Preferably, the controller 50 will prevent activation of the engine 32 before the start-up state is completed.

In the start-up state, the solenoid valve 46 remains initially closed to prevent the flow of coolant from the tank 38 into the radiator 24 through the tubes 74, 76. The controller 50 opens the valve 44 and turns on and reverses the pump 28 so that the pump 28 draws coolant from the surge tank 38 through the valve 44 and the heat exchanger 30 as shown by the arrows 92. The pump 28 then returns the coolant to the jacket 22, as shown by the arrows 94.

Several ancillary advantages of this arrangement will be recognized. Because the pump 28 is a positive displacement pump, the coolant may be returned to the jacket 22 regardless of the output head on the circulation pump 26. Moreover, because the coolant flows first through the heat exchanger 30 after exiting the tank 38, the air stream 34 passing through the heat exchanger 30 may be advantageously heated through heat exchange with the withdrawn coolant to heat the cabin 36 at a time even before the engine 32 is activated. The thermal energy remaining in the coolant after it passes through the heat exchanger 30 may be used to pre-warm the engine 32 via the jacket 22 and/or the radiator 24 via pipe 64.

Once a sufficient amount of coolant has been returned to the jacket 22, the controller 50 turns off the pump 28 and opens the valve 46 to allow coolant to pass through the tank 38. The controller 50 then places the system 20 in either the stand-by or heating states as desired by the user and allows operation of the engine 32.

A coolant system 96 according to another embodiment of the present invention is shown in FIGS. 5–7, with elements similar to those mentioned previously numbered similarly. The coolant system 96 differs principally from the system 20 in that separate tanks 98, 100 are used for surge tank and heat battery functions, and the system 96 does not have separate stand-by and heating states (see FIG. 5). The tank 100 is insulated just as the tank 38. The systems 20, 96 share common features in that i) the stored coolant is withdrawn from the remainder of the coolant system 20, 96 when the engine 32 is turned off, ii) the stored coolant is substantially returned to the remainder of the system 20, 96 when the engine 32 is turned on, and iii) the coolant in the storage container 38, 100 is continually warmed and circulated during operation of the engine 32.

Referring then first to FIG. 5, which illustrates a stand-by condition, the coolant system 96 includes the jacket 22, the radiator 24, and the circulation pump 26. As in the system 20, the pump 26 causes coolant to circulate between the jacket 22 and the radiator 24 through the conduits 62, 64, 66 in the direction of the arrows 68. Coolant also circulates through conduits 102, 104, 106 through the tank 100 (preferably located at the lowest elevation in the system 96) and the secondary heat exchanger 30 as shown by the arrows 108. A check valve 110 is disposed in the conduit 102 to prevent coolant from flowing back from the tank 100 into the conduit 62.

Additionally, as shown in FIG. 5, coolant may flow from the radiator 24 to the surge tank 98 (preferably located at the highest elevation in the system 96) through a conduit 112 connected to a first port 114 of the surge tank 98 and return from a second port 116 of the tank 98 through a conduit 118 to the radiator 24 as shown by the arrows 120. A valve 122 is connected to a third port 124 of the tank 98 and to the ambient, and controls the intake and exhaust of air from the tank 98. A filter 126 is connected to the ambient side port of the valve 122 to prevent the intake of dirt and debris.

In FIG. 6, a second operational state corresponding to the storage state identified above for the system 20 is shown, and will also be referred to as the storage state. In this state, coolant is withdrawn from the remainder of the coolant system 96 as it was in the system 20. However, the mechanism and method by which the coolant is withdrawn from the system 96 is significantly different from that used in the system 20.

In particular, the insulated tank 100 has an inner container 128 with a first wall 130 which defines a receptacle 132. A second moveable wall or diaphragm 134 in the form of a flexible membrane is attached to the first wall 130 within the receptacle 132, and divides the receptacle 132 into first and second reservoirs 136, 138. The reservoir 136 is referred to as the coolant storage reservoir, while the reservoir 138 is referred to as the control fluid reservoir.

It will be recognized that a change in the volume of the reservoir 136 through the movement of the wall 134 relative to the wall 130 causes a corresponding change in the volume of the reservoir 138. By increasing or decreasing the amount of control fluid in the control fluid reservoir 138, coolant can be drawn into or expelled from the coolant storage reservoir 136 via first and second ports 140, 142. Further, by maintaining a constant or near constant volume of control fluid in the control fluid reservoir 138, the diaphragm 134 can assume a semi-rigid state, causing the storage reservoir 136 to function like a conduit through which the coolant may pass.

To pump control fluid, for example ambient air, in and out of the control fluid reservoir 138 of the tank 100, a reversible pump 144 is connected to a third port 146 of the tank 100 via a solenoid valve 148 and conduits 150, 152. A filter 154 is also connected to a port of the pump 144 connected to the ambient to prevent intake of dirt and debris. By operating the pump 144 in a first operational state, control fluid is pumped into the control fluid reservoir 138, while by reversing the operation of the pump 144, control fluid is pumped out of the control fluid reservoir 138. By closing the valve 148, the volume of control fluid within the control fluid reservoir 138 may be maintained at a substantially constant volume.

Therefore, in going from the stand-by state shown in FIG. 5 to the storage state shown in FIG. 6, the controller 50, which is connected to the pumps 26, 144 and valves 122, 148 by outputs 156, 158, 160, 162, responds to a signal on the input 52 that the engine 32 is being turned off by turning off the pump 26, turning on the pump 144 and opening the valves 122, 148 after a time delay to allow the engine 32 to cool, as before. By turning on the pump 144, control fluid is pumped out of the control fluid reservoir 138, thus enlarging the coolant reservoir 136. The expansion of the coolant reservoir 136 draws coolant from the jacket 22 and the radiator 24 (as shown by arrows 164), which is replaced with air drawn through the filter 126, valve 122 and surge tank 98. Once a sufficient amount of coolant has been withdrawn from the remainder of the coolant system 96 to fill the coolant reservoir 136 of the tank 100, the valve 148 is closed to maintain the diaphragm in a semi-rigid form.

In going from the storage state of FIG. 6 to the start-up state of FIG. 7, the controller 50 first determines that the user desires to start the engine 32. In response, the controller 50 opens the valves 122 and 148 and turns on and reverses the operation of the pump 144. By turning on and reversing the operation of the pump 144, control fluid is drawn in through the filter 154 and pumped into the control fluid reservoir 138 of the tank 100. The movement of control fluid into the control fluid reservoir 138 causes coolant to be expelled from the second port 142 of the tank 100 through the heat exchanger 30 into the jacket 22 and the radiator 24. The air displaced by the coolant is forced into the surge tank 98 to be exhausted into the environment via the valve 122. Once a sufficient amount of coolant has been expelled from the tank 100, the valve 148 is closed to maintain the diaphragm 134 in a semi-rigid state, and operation proceeds according to the stand-by state discussed above relative to FIG. 5.

As mentioned previously, the systems 20, 96 according to the present invention do not require additional coolant to be added to the system 20, 96 for thermal energy storage. Moreover, the weight of the system 20 is further decreased by using a single container as surge tank and heat battery. Further, both systems 20, 96 provide for the coolant in the storage tank to be warmed during operation of the vehicle by running a stream of heated coolant through the storage tank. Also, both systems 20, 96 provide for the coolant contained in the storage tank to be fully accessible to the remainder of the system 20, 96, thereby reducing or eliminating "lost" coolant which is not available for use in the remainder of the system 20, 96 when the heat battery is not in use.

It should be appreciated that while the invention has been described herein in connection with an engine 32 of a vehicle and a secondary heat exchanger 30 that can be used for providing heat to a cabin 36 of the vehicle, the invention may find use in other applications, including applications wherein the engine is replaced by some other heat generating component and the secondary heat exchanger 30 is replaced by some other heat receiving component. For example, the system 20 could be used to preheat fuel cell coolant to heat a fuel cell stack during start-up, with the heat generating component being the fuel cell stack for a stationary fuel cell system, or an engine 32 and/or the fuel cell stack on a hybrid vehicle. By way of further example, the system could be used simply to preheat the engine by circulating the coolant from the tank 38 through the engine jacket 22 or to preheat the transmission by circulating the coolant through a transmission jacket or through a coolant/transmission fluid heat exchanger. In both of the aforementioned cases (preheating the engine and/or preheating the transmission), the secondary heat exchanger 30 could be an optional component that is either included in the system 20 or not included in the system 20.

It should also be understood that while the pump 26 for both the systems 20 and 96 has been described as one that can be controlled by the controller 50, such as an electric motor driven pump, in some applications, and particularly when used in connection with an engine 32 of a vehicle, the pump 26 may be directly driven by the engine rather than being controlled by the controller 50 such that the pump 26 will be pumping whenever the engine 32 is running and not pumping whenever the engine 32 is off. In such a configuration, the controller 50 would still command the pumps 28 and 144 as previously described, with the pumps 28 and 144 doing any additional work required by the nonoperation of the pump 26 when the engine 32 is off. In this regard, it should be appreciated that the pump 26 would preferably be of a type that allows passage of the coolant through its operating components when the pump 26 is in a nonoperating condition so as to allow the coolant to be pulled from all parts of the system by the pumps 28 and 144.

Still other aspects, objects, and advantages of the present invention can be obtained from a study of the specification, the drawings, and the appended claims.

The invention claimed is:

1. A coolant system comprising:

a heat exchange circuit capable of being in a heat exchange relationship with an engine to remove thermal energy from the engine and transfer the thermal energy to a coolant;

an insulated tank in fluid communication with the heat exchange circuit; and a control and associated conduits and valves for passing coolant through the heat exchange circuit and the insulated tank so as to fill the tank with a first volume of coolant in a first operational state, for passing an additional amount of coolant from the heat exchange circuit into the insulated tank so as to fill the insulated tank with a second volume of coolant which is greater than the first volume of coolant in a second operational state, and for passing the additional amount of coolant from the insulated tank to the heat exchange circuit in a third operational state.

2. The coolant system according to claim 1, wherein:

the insulated tank has first and second ports, and the control comprises a first valve in fluid communication with the first port and the heat exchange circuit, a second valve in fluid communication with the second port and the heat exchange circuit, the first and second valves having a first operational state wherein both valves are open to allow coolant to pass from the heat exchange circuit through the tank and a second operational state wherein the first valve is open and the second valve is closed to allow coolant to enter or exit the tank, and a pump in fluid communication with the heat exchange circuit and the first valve and having a first operational state wherein the pump passes coolant from the heat exchange circuit into the tank and a second operational state wherein the pump passes coolant from the tank to the heat exchange circuit.

3. The coolant system according to claim 2, wherein the pump comprises a reversible, positive displacement pump.

4. The coolant system according to claim 3, further comprising a conduit in fluid communication with the heat exchange circuit and the first port of the tank to allow coolant to pass between the heat exchange circuit and the tank without passing through the first valve.

5. The coolant system according to claim 4, further comprising a third valve in fluid communication with the conduit to limit the flow of coolant from the tank to the heat exchange circuit through the conduit.

6. The coolant system according to claim 5, wherein the third valve comprises a check valve.

7. The coolant system according to claim 2, further comprising a coolant-to-air heat exchanger in fluid communication with the first valve and the pump to receive coolant passing between the tank and the heat exchange circuit.

8. The coolant system according to claim 2, wherein the heat exchange circuit comprises a radiator, an engine jacket in fluid communication with the radiator, and a circulation pump in fluid communication with the radiator and the engine jacket to pass coolant between the radiator and the engine jacket.

9. The coolant system according to claim 1, wherein:

the insulated tank has a first wall; and the control includes a second wall which with the first wall defines a coolant reservoir therebetween in fluid communication with the heat exchange circuit, the second wall being moveable relative to the first wall between first and second positions to vary the volume of the coolant reservoir between the first volume and the second volume.

10. The coolant system according to claim 9, wherein the first wall encloses a space, and the second wall is disposed in the space to divide the space to define the coolant reservoir and a control fluid reservoir, the coolant reservoir and the control fluid reservoir being hydraulically isolated from each other.

11. The coolant system according to claim 10, wherein the second wall comprises a flexible membrane.

12. The coolant system according to claim 10, the control further comprising a pump in fluid communication with the control fluid reservoir to pass control fluid into the control fluid reservoir in a first operational state to move the second wall in a first direction and to pass fluid out of the control fluid reservoir in a second operation state to move the second wall in a second direction opposite to the first direction.

13. The coolant system according to claim 12, the control further comprising a valve in fluid communication with the control fluid reservoir and the pump, the valve having a first operational state wherein the valve is open to allow fluid to pass between the control fluid reservoir and the pump and a second operational state wherein the valve is closed to limit fluid from passing between the control fluid reservoir and the pump.

14. A coolant system comprising:

a heat exchange circuit capable of being in a heat exchange relationship with an engine to remove thermal energy from the engine and transfer the thermal energy to a coolant;

an insulated tank having first and second ports;

a first valve in fluid communication with the first port and the heat exchange circuit;

a second valve in fluid communication with the second port and the heat exchange circuit;

the first and second valves having a first operational state wherein both valves are open to allow coolant to pass from the heat exchange circuit through the tank and a second operational state wherein the first valve is open and the second valve is closed to allow coolant to enter or exit the tank to alter the volume of coolant stored in the tank; and a pump in fluid communication with the heat exchange circuit and the first valve and having a first operational state wherein the pump passes coolant from the heat exchange circuit into the tank and a second operational state wherein the pump passes coolant from the tank to the heat exchange circuit.

15. A coolant system comprising:

a heat exchange circuit capable of being in a heat exchange relationship with an engine to remove thermal energy from the engine and transfer the thermal energy to a coolant;

an insulated tank having a first wall; and a second wall which with the first wall defines a coolant reservoir therebetween in fluid communication with the heat exchange circuit, the second wall being moveable relative to the first wall between first and second positions to vary the volume of the coolant reservoir between the first volume and the second volume, wherein the first wall encloses a space, and the second wall is disposed in the space to divide the space to define the coolant reservoir and a control fluid reservoir, the coolant reservoir and the control fluid reservoir being hydraulically isolated from each other.

16. A method of operating a coolant system to store thermal energy comprising the steps of:

providing an engine, a heat exchange circuit in a heat exchange relationship with the engine to remove thermal energy from the engine and transfer the thermal energy to a coolant and an insulated tank;

passing the coolant through the heat exchange circuit and the insulated tank so as to fill the tank with a first volume of coolant in a first operational state;

passing an additional amount of coolant from the heat exchange circuit into the insulated tank so as to fill the insulated tank with a second volume of coolant which is greater than the first volume of coolant in a second operational state;

retaining the second volume of coolant in the insulated tank in a third operational state; and passing the additional amount of coolant from the insulated tank to the heat exchange circuit in a fourth operational state.

17. The method according to claim 16, wherein the step of passing an additional amount of coolant from the heat exchange circuit to the insulated tank comprises the sequential steps of deactivating the engine, waiting a period of time, and passing an additional amount of coolant from the heat exchange circuit into the insulated tank so as to fill the insulated tank with a second volume of coolant which is greater than the first volume of coolant in a second operational state after the period of time has elapsed.

18. The method according to claim 16, wherein the step of passing the additional amount of coolant from the insulated tank to the heat exchange circuit comprises the sequential steps of determining whether an engine activation signal is present, and passing the additional amount of coolant from the insulated tank to the heat exchange circuit in a fourth operational state if the engine activation signal is present.

19. The method according to claim 16, wherein:

the step of providing an insulated tank comprises the step of providing an insulated tank with first and second spaced walls defining a coolant reservoir therebetween in fluid communication with the heat exchange circuit, the second wall being moveable relative to the first wall to vary the volume of the coolant reservoir;

the step of passing an additional amount of coolant from the heat exchange circuit into the insulated tank comprises the step of moving the second wall in a first direction to draw coolant from the heat exchange circuit into the coolant reservoir; and the step of passing the additional amount of coolant from the insulated tank to the heat exchange circuit comprises the step of moving the second wall in a second direction opposite to the first direction to exhaust the coolant from the coolant reservoir into the heat exchange circuit.

20. The method according to claim 19, wherein the step of moving the second wall in a first direction to draw coolant from the heat exchange circuit into the coolant reservoir comprises the sequential steps of deactivating the engine, waiting a period of time, and moving the second wall in a first direction to draw coolant from the heat exchange circuit into the coolant reservoir after the period of time has elapsed.

21. The method according to claim 19, wherein the step of moving the second wall in a second direction opposite to the first direction to exhaust the coolant from the coolant reservoir into the heat exchange circuit comprises the sequential steps of determining whether an engine activation signal is present, and moving the second wall in a second direction opposite to the first direction to exhaust the coolant from the coolant reservoir into the heat exchange circuit if the engine activation signal is present.

22. A coolant system comprising:

a heat exchange circuit capable of being in a heat exchange relationship with a heat generating component to remove thermal energy therefrom and transfer the thermal energy to a coolant;

an insulated tank in fluid communication with the heat exchange circuit; and a control and associated conduits and valves for passing coolant through the heat exchange circuit and the insulated tank so as to fill the tank with a first volume of coolant in a first operational state, for passing an additional amount of coolant from the heat exchange circuit into the insulated tank so as to fill the insulated tank with a second volume of coolant which is greater than the first volume of coolant in a second operational state, and for passing the additional amount of coolant from the insulated tank to the heat exchange circuit in a third operational state.

23. The coolant system according to claim 22, wherein:

the insulated tank has first and second ports, and the control comprises a first valve in fluid communication with the first port and the heat exchange circuit, a second valve in fluid communication with the second port and the heat exchange circuit, the first and second valves having a first operational state wherein both valves are open to allow coolant to pass from the heat exchange circuit through the tank and a second operational state wherein the first valve is open and the second valve is closed to allow coolant to enter or exit the tank, and a pump in fluid communication with the heat exchange circuit and the first valve and having a first operational state wherein the pump passes coolant from the heat exchange circuit into the tank and a second operational state wherein the pump passes coolant from the tank to the heat exchange circuit.

24. The coolant system according to claim 23, wherein the pump comprises a reversible, positive displacement pump.

25. The coolant system according to claim 24, further comprising a conduit in fluid communication with the heat exchange circuit and the first port of the tank to allow coolant to pass between the heat exchange circuit and the tank without passing through the first valve.

26. The coolant system according to claim 25, further comprising a third valve in fluid communication with the conduit to limit the flow of coolant from the tank to the heat exchange circuit through the conduit.

27. The coolant system according to claim 26, wherein the third valve comprises a check valve.

28. The coolant system according to claim 22, wherein:

the insulated tank has a first wall; and the control includes a second wall which with the first wall defines a coolant reservoir therebetween in fluid communication with the heat exchange circuit, the second wall being moveable relative to the first wall between first and second positions to vary the volume of the coolant reservoir between the first volume and the second volume.

29. The coolant system according to claim 28, wherein the first wall encloses a space, and the second wall is disposed in the space to divide the space to define the coolant reservoir and a control fluid reservoir, the coolant reservoir and the control fluid reservoir being hydraulically isolated from each other.

30. The coolant system according to claim 29, wherein the second wall comprises a flexible membrane.

31. The coolant system according to claim 29, the control further comprising a pump in fluid communication with the control fluid reservoir to pass control fluid into the control fluid reservoir in a first operational state to move the second wall in a first direction and to pass fluid out of the control fluid reservoir in a second operation state to move the second wall in a second direction opposite to the first direction.

32. The coolant system according to claim 31, the control further comprising a valve in fluid communication with the control fluid reservoir and the pump, the valve having a first operational state wherein the valve is open to allow fluid to pass between the control fluid reservoir and the pump and a second operational state wherein the valve is closed to limit fluid from passing between the control fluid reservoir and the pump.

33. A coolant system comprising:

a heat exchange circuit capable of being in a heat exchange relationship with a heat generating component to remove thermal energy therefrom and transfer the thermal energy to a coolant;

an insulated tank having first and second ports;

a first valve in fluid communication with the first port and the heat exchange circuit;

a second valve in fluid communication with the second port and the heat exchange circuit;

the first and second valves having a first operational state wherein both valves are open to allow coolant to pass from the heat exchange circuit through the tank and a second operational state wherein the first valve is open and the second valve is closed to allow coolant to enter or exit the tank to alter the volume of coolant stored in the tank; and a pump in fluid communication with the heat exchange circuit and the first valve and having a first operational state wherein the pump passes coolant from the heat exchange circuit into the tank and a second operational state wherein the pump passes coolant from the tank to the heat exchange circuit.

34. A coolant system comprising:

a heat exchange circuit capable of being in a heat exchange relationship with a heat generating component to remove thermal energy therefrom and transfer the thermal energy to a coolant;

an insulated tank having a first wall; and a second wall which with the first wall defines a coolant reservoir therebetween in fluid communication with the heat exchange circuit, the second wall being moveable relative to the first wall between first and second positions to vary the volume of the coolant reservoir between the first volume and the second volume, wherein the first wall encloses a space, and the second wall is disposed in the space to divide the space to define the coolant reservoir and a control fluid reservoir, the coolant reservoir and the control fluid reservoir being hydraulically isolated from each other.

35. A method of operating a coolant system to store thermal energy comprising the steps of:

providing a heat exchange circuit in a heat exchange relationship with a heat generating component to remove thermal energy therefrom and transfer the thermal energy to a coolant and an insulated tank;

passing the coolant through the heat exchange circuit and the insulated tank so as to fill the tank with a first volume of coolant in a first operational state;

passing an additional amount of coolant from the heat exchange circuit into the insulated tank so as to fill the insulated tank with a second volume of coolant which is greater than the first volume of coolant in a second operational state;

retaining the second volume of coolant in the insulated tank in a third operational state; and passing the additional amount of coolant from the insulated tank to the heat exchange circuit in a fourth operational state.

36. The method according to claim 35, wherein:

the step of providing an insulated tank comprises the step of providing an insulated tank with first and second spaced walls defining a coolant reservoir therebetween in fluid communication with the heat exchange circuit, the second wall being moveable relative to the first wall to vary the volume of the coolant reservoir;

the step of passing an additional amount of coolant from the heat exchange circuit into the insulated tank comprises the step of moving the second wall in a first direction to draw coolant from the heat exchange circuit into the coolant reservoir; and the step of passing the additional amount of coolant from the insulated tank to the heat exchange circuit comprises the step of moving the second wall in a second direction opposite to the first direction to exhaust the coolant from the coolant reservoir into the heat exchange circuit.

* * * * *